United States Patent [19]

McGrath

[11] 4,363,157

[45] Dec. 14, 1982

[54] BUFFING PAD CLEANING TOOL

[75] Inventor: Richard F. McGrath, Shoreview, Minn.

[73] Assignee: Minnesota Mining and Manufacturing Company, Saint Paul, Minn.

[21] Appl. No.: 262,481

[22] Filed: May 11, 1981

[51] Int. Cl.[3] ..... A47L 5/14

[52] U.S. Cl. ..... 15/388; 15/142; 15/405

[58] Field of Search ..... 15/92, 142, 141 A, 364, 15/366, 383, 388, 405

[56] References Cited

U.S. PATENT DOCUMENTS

| | | | |
|---|---|---|---|
| 1,209,722 | 12/1916 | Kirby | 15/388 X |
| 1,907,642 | 5/1933 | Demaree | 15/141 A |
| 3,694,848 | 10/1972 | Alcala | 15/346 |
| 3,852,844 | 12/1974 | Hukuba | 15/142 |
| 3,878,582 | 4/1975 | Hukuba | 15/142 X |
| 4,087,879 | 5/1978 | Spence | 15/142 |

*Primary Examiner*—Chris K. Moore

*Attorney, Agent, or Firm*—Cruzan Alexander; Donald M. Sell; William L. Huebsch

[57] ABSTRACT

A hand-held buffing pad cleaning tool providing both a plurality of spaced star wheels and an operator-activatable air nozzle for simultaneously drying finishing material in the fibers of a buffing pad, loosening the dried material and blowing it away.

3 Claims, 2 Drawing Figures

BUFFING PAD CLEANING TOOL

TECHNICAL FIELD

This invention relates to devices for cleaning and drying buffing pads of the type typically used to apply moist finish treating materials such as polishing compounds to automobile finishes.

BACKGROUND ART

Buffing pads of the type used to apply moist finish treating materials such as polishes, waxes, glazes, cleaners and rubbing compounds to the finish of automobiles typically comprise a backing layer which may be of a tough material such as leather or canvas from which project fibers that may have been tufted through or sewn to the backing layer; or, in the case of natural sheep hide wool buffing pad, may have grown in the backing layer. Such pads tend to retain finish treating materials in the fibers which must be removed from the pad after it is used to retain its usefulness. Such pads may be cleaned by washing them in a suitable solvent and then drying them, however, this cleaning method usually requires sending the pads to a location other than that at which they are used. Preferably the pads are cleaned at the location at which they are used which has been done by directing a jet of air against the pad to dry the liquid vehicle or solvent in the treating material and then, in a separate step applying a plurality of rotatable coaxial star wheels against the fibers of the buffing pad as the pad is rotated to remove the dried residue of the treating materials, or digging that residue from the pads with instruments such as screwdriver, rods or putty knives.

DISCLOSURE OF INVENTION

The present invention provides a single buffing pad cleaning tool that allows an operator to apply a jet of air to a rotating buffing pad to dry liquid vehicle or solvent in cleaning material retained in fibers on the pad and, at the same time, to apply a plurality of star wheels to the fibers to loosen the dried cleaning material so that it will be blown away by the air jet.

According to the present invention there is provided a cleaning tool for cleaning buffing pads comprising a frame having a first end portion adapted for manual engagement and a second projecting end portion; a plurality of coaxially spaced star wheels rotatably mounted in side-by-side spaced relationship on the second end portion of the frame; an air nozzle mounted on the frame and positioned to direct air passing through the nozzle generally toward one side of the star wheels; means affording coupling of a supply of high pressure air to the nozzle comprising a valve assembly having inlet and outlet ports and mounted on the frame, a passageway connecting the outlet port of the valve assembly with the nozzle, and means for coupling the inlet port of the valve assembly to a supply of air under high pressure; and means affording manually activation of the valve means.

The simultaneous application of a jet of air and star wheels afforded by such a cleaning tool produces the synergistic effect of simultaneously drying finish treating material in the buffing pad, loosening dried material from the fibers and blowing the dried material away which has been found to provide more thorough cleaning of a buffing pad in a given time period than can be provided by applying the star wheels and the air jet in separate applications each for the same period of time.

BRIEF DESCRIPTION OF DRAWING

The present invention will be more thoroughly described with reference to the accompanying drawing wherein like numbers refer to like parts in the several views, and wherein.

DETAILED DESCRIPTION

Figure 1:
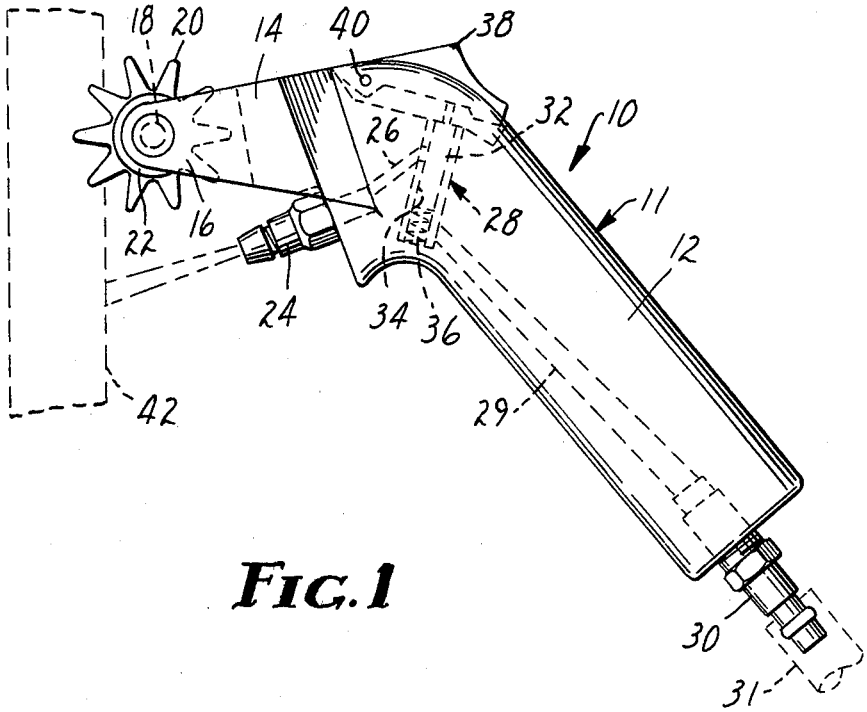
FIG. 1 is a side view of a polishing pad cleaning tool according to the present invention shown in engagement with a polishing pad.
Figure 2:
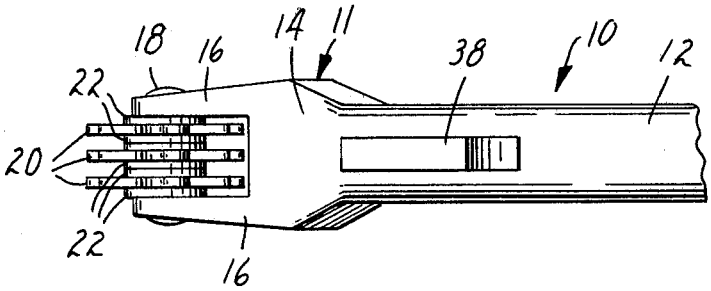
FIG. 2 is a fragmentary top view of the polishing pad cleaning tool of FIG. 1.

Referring now to the drawing there is shown a buffing pad cleaning tool according to the present invention generally designated by the reference numeral 10.

The tool 10 comprises a frame 11 including a first end or handle portion 12 which is generally cylindrical in cross section so as to be adapted for manual engagement; and a second tapered projecting end portion 14 disposed with respect to the axis of the handle portion 12 at an obtuse angle (e.g., about 125 degrees), and bifurcated to provide two support parts 16 between which extends a transverse shaft 18 on which are rotatably and coaxially supported a plurality of star wheels or spur rowels 20 spaced apart by spacing washers 22.

Also mounted on the frame 11 is an air nozzle 24 having a distal end portion directed generally centrally toward the edge of the spaced star wheels 20 adjacent the handle portion 12. Means are provided which afford coupling a supply of high pressure air to the nozzle 24, which means comprise a passageway 26 connecting the inlet of the air nozzle 24 to the outlet of a valve assembly 28, and a passageway 29 connecting an inlet opening of the air valve assembly 28 to the male portion 30 of a quick disconnect coupling, the female half 31 of which coupling may be attached to the end of a high pressure air supply hose (not shown).

The air valve assembly 28 is preferably of the type typically used in the stem of automobile tires, which valve assembly 28 comprises an elongate movable member 32 axially slidably mounted in a bore 34 in the frame 11 and biased by a spring 36 to a closed position at which air flow through the bore 34 is blocked by the movable member 32 and at which a portion of the movable member 32 projects outwardly of the bore 34. The movable member 32 is movable against the bias of the spring 36 to an open position, further within the bore 34 at which air can flow through the bore 34, the passageway 26, and the nozzle 24.

An air valve activating lever 38 is pivotably mounted by a pin 40 on the frame 11 between its handle portion 12 and its projecting end portion 14, and has a portion within a slot in the frame 11 resting against the outer end of the movable member 32. The outer surface of the valve activating lever 38 is shaped for manual engagement to facilitate movement of the movable member 32 of the air valve assembly 28 to its open position so that air will flow through the nozzle 24.

In operation a user applies the star wheels 20 to the surface of a rotating polishing pad 42 with the shaft 18 generally transverse of the direction of movement of the surface contacted by the star wheels 20. He then presses the activating lever 38 to open the air valve assembly 28 so that a jet of air will pass through the nozzle 24 to dry the solvent in the finishing treating material (e.g. such as in "Super Duty Rubbing Compound" sold by 3M Company of St. Paul, Minn.) so that the finish treating material will dry in the fibers of the buffing pad 42, and the star wheels 20 will loosen the dried finish treating material which will be blown away by the jet of air.

I claim:

1. A cleaning tool for removing debris from buffing pads comprising:

a frame having a first end portion adapted for manual engagement and a second projecting end portion;

a plurality of spaced star wheels rotatably coaxially mounted in side-by-side spaced relationship on the second end portion of said frame;

an air nozzle mounted on said frame and positioned to direct air passing through said nozzle generally toward one side of said star wheels;

means affording coupling of a supply of high pressure air to said nozzle comprising a valve assembly having inlet and outlet ports and mounted on said frame, a passageway connecting the outlet port of said valve with said nozzle, and means for coupling the inlet port of said valve assembly to a supply of high pressure air; and means mounted on said frame for manually activating said valve means.

2. A cleaning tool according to claim 1 wherein said valve means comprises a movable member mounted for movement on said frame between an off position blocking flow of air through said valve assembly, and an on position permitting the flow of air through said valve assembly; and means for biasing said movable member to said off position, and said means for manually activating said valve means comprises a valve activating member in contact with said movable member and movably mounted on said frame between said first end portion and said star wheels, said valve activating member being adapted for manual engagment to move said movable member to its on position in opposition to said biasing means.

3. A cleaning tool according to claim 1 or claim 2 wherein said handle portion and said projecting portion are disposed generally at an obtuse angle, and said nozzle directs air centrally toward the side of said star wheels adjacent said handle portion.

* * * * *